US005755614A

United States Patent [19]

Adams et al.

[11] Patent Number: 5,755,614

[45] Date of Patent: May 26, 1998

[54] RINSE WATER RECYCLING IN CMP APPARATUS

[75] Inventors: John A. Adams, Escondido; Gerald A. Krulik, San Clemente, both of Calif.; C. Randall Harwood, Tempe, Ariz.

[73] Assignee: Integrated Process Equipment Corporation, Phoenix, Ariz.

[21] Appl. No.: 819,533

[22] Filed: Mar. 17, 1997

Related U.S. Application Data

[62] Division of Ser. No. 681,794, Jul. 29, 1996, Pat. No. 5,664,990.

[51] Int. Cl.[6] ..... B24B 57/00

[52] U.S. Cl. ..... 451/60; 451/41; 451/54; 451/287; 134/902

[58] Field of Search ..... 451/36, 60, 56, 451/54, 41, 285, 287, 288, 443, 446, 453, 444; 134/902, 153, 148

[56] References Cited

U.S. PATENT DOCUMENTS

| | | | |
|---|---|---|---|
| 3,905,162 | 9/1975 | Lawrence et al. | 451/36 |
| 4,059,929 | 11/1977 | Bishop | 451/446 |
| 5,142,828 | 9/1992 | Curry, II | 451/36 |
| 5,490,809 | 2/1996 | Jones et al. | 451/446 |
| 5,545,076 | 8/1996 | Yun et al. | 451/285 |
| 5,575,705 | 11/1996 | Yam et al. | 451/39 |

*Primary Examiner*—Eileen P. Morgan

[57] ABSTRACT

Recycled slurry is continuously blended with the slurry in use to provide a consistent polishing rate while consuming or discarding a small fraction of the slurry flowing continuously across the polishing pad. The slurry is recovered in a catch ring and fed to a recycle loop to blend the recovered slurry with fresh slurry, rejuvenating chemicals, or water; test the blend; filter the blend; and return the blend to the polishing pad. The volume returned to the pad slightly exceeds the volume recovered, causing the catch ring to overflow. Rinse water is recycled in the same fashion to keep the polishing pad wet between polishing cycles.

3 Claims, 2 Drawing Sheets

RINSE WATER RECYCLING IN CMP APPARATUS

This is a division, of application Ser. No. 08/681,794 filed Jul. 29, 1996, now U.S. Pat. No. 5,664,990.

BACKGROUND OF THE INVENTION

This invention relates to chemical-mechanical polishing (CMP) system and, in particular, to a method and an apparatus in which slurry is recycled and rejuvenated.

CMP apparatus is used primarily for polishing or "planarizing" the front face or device side of a semiconductor wafer. A polishing step is performed one or more times during the process for making integrated circuits and provides several advantages. For example, step coverage is improved because the size of a step is decreased. Lithography, projecting an image onto a layer of photoresist, is improved by a flatter surface. If the layer of photoresist were uneven; there is a chance that part of the image would be out of focus. Thus, polishing a wafer improves patterning the photoresist and improves the quality of the resulting devices.

In a typical CMP apparatus, a semiconductor wafer is rotated against a rotating polishing pad while an abrasive and chemically reactive solution, slurry, is supplied to the rotating pad. A polishing pad is typically constructed in two layers overlying a metal platen with the less resilient layer as the outer layer of the pad. The layers are typically made of polyurethane and may include a filler for controlling the dimensional stability of a layer. The platens used for a polishing pad and for a polishing head are carefully machined to have optically flat, parallel surfaces.

A polishing pad is typically two or three times the diameter of the wafer being polished and the wafer is kept off-center on the pad to prevent grinding a non-planar surface into the wafer. The axis of rotation of the wafer and the axis of the rotation of the pad are parallel, but not collinear, to keep the front face of the wafer parallel with the back face. Other CMP apparatus use an oscillating pad or a continuous belt pad. The invention is described in conjunction with a rotating pad and is applicable to any type of pad.

The parameters of polishing, such as the downward pressure on the wafer, the rotational speed of the carrier, the speed of the pad, the flow rate of the slurry, and the pH of the slurry, are carefully controlled to provide a uniform removal rate, a uniform polish across the surface of a wafer, and consistency from wafer to wafer.

Slurries used for CMP can be divided into three categories, depending on their intended use: silicon polish slurries, oxide polish slurries, and metal polish slurries.

A silicon polish slurry is designed to polish and planarize bare silicon wafers. A silicon polish is typically composed of very small abrasive, such as silica ($SiO_2$), alumina ($Al_2O_3$), or ceria ($Ce_2O_3$) particles, of typically 20–200 nanometers in diameter, suspended in a water-based liquid. A common silicon polishing slurry uses silica particles in a colloidal suspension. The proportion of particles in a slurry is typically from 1–15% by weight. The pH of the slurry is typically from 8.0–11.5 and is controlled by the addition of an alkali, such as NaOH, KOH, or $NH_4OH$.

An oxide polish slurry is designed to polish and planarize a dielectric layer on a wafer, typically a layer of silicon dioxide. The dielectric layer is formed by techniques well known in the art, such as oxidation or chemical vapor deposition. An oxide polish slurry is typically composed of very small abrasive, such as silica, alumina, or ceria particles 50–1000 nanometers in diameter, suspended in a water based liquid. The proportion of the particles in an oxide polish slurry is typically 1–15% by weight. The pH is kept above 8 and is typically 10.0–11.5. The pH of a slurry is controlled by the addition of an alkali. U.S. Pat. No. 4,910,155 (Cote and Leach) describes procedures and materials for oxide polishing.

A metals polish slurry is designed to polish and planarize a conductive layer on a semiconductive wafer. The conductive layer is typically deposited on a dielectric layer and can be any one of several conductive materials such as tungsten, titanium, aluminum, copper, doped silicon, doped polysilicon, or a metal silicide layer. The dielectric layer typically has openings ("vias") that are filled with the conductive material is to provide a path through the dielectric layer to previously deposited layers. After the conductive layer is polished, only the conductive material in the vias remains in the dielectric layer.

A metals polish typically includes very small particles of abrasive, such as silica, alumina, or ceria having a diameter of 50–1000 nanometers and suspended in a water based liquid. The proportion of the particles in the slurry is typically 1–5% by weight and the pH is typically less than 5. The pH of a metals polish slurry is optionally controlled by the addition of organic acids such as potassium acetate, acetic acid, or citric acid. In addition to the organic acid, the slurry may include one or more oxidizing agents to remove the conductive material. Typical oxidizers include hydrogen peroxide, potassium ferricyanide, ferric nitrate, or mixtures thereof. U.S. Pat. No. 5,340,370 (Cadien) describes a metals polishing process and some slurries that have been developed for metals polishing.

Slurries for CMP are commercially available from such companies as CABOT, Cab-0-sil Division, Tuscola, Ill. and Rodel Inc., Newark, Del.

As a wafer is polished, the slurry and abraded materials tend to glaze the surface of the pad, making the pad slick and reducing the polishing rate. Polishing can produce stray particles from the pad material, the wafer itself, or elsewhere. When these by-products are of sufficient concentration to adversely affect the polishing, they should be removed.

The slurry also changes chemically during the polishing process, changing composition and pH. The pH typically changes in an unfavorable direction and, as a result, a wafer polishes more slowly at the end of the life of the slurry than at the beginning. If a slurry contains an oxidizer, the oxidizer is partially consumed in the polishing process.

Conditioning a polishing pad removes old slurry particles and abraded particles from the pad and refreshes the surface of the pad with new slurry. Conditioning a pad typically includes removing the glaze and producing a microscopic roughness on the surface of the pad. Scraping the pad with a sharp object or roughening the pad with an abrasive restores the pad surface.

In many CMP systems, especially those used by large volume semiconductor manufacturers, the slurry flows continuously onto the polishing pad. As the pad rotates, slurry is flung off the edge and carried away by a drain. Although a continuous flow of fresh slurry is beneficial and desirable, one must provide a large quantity of slurry.

U.S. Pat. No. 5,299,393 (Chandler) discloses a removable containment device or dam that surrounds a rotating polishing pad. The dam enables one to store slurry on the polishing pad and to use considerably less slurry to polish a wafer.

Because the slurry is being used in batches, the polishing rate decreases continuously during polishing until the batch is replaced, then the polishing rate abruptly increases. Such changes make it difficult to characterize a process accurately.

A dam also limits how quickly a CMP system can polish wafers. At high rotational speeds of the pad, the slurry is driven to the outer edges of the pad, producing an uneven distribution of slurry on the pad and causing uneven polishing. To reduce the centrifugal effect, the pad must be rotated at slower speeds than without the dam. Slower rotation is undesirable because it reduces the polishing rate.

In addition to slurry, a large volume of rinse water is used to remove the slurry particles and chemicals from the wafer and the various pads and parts of the equipment. Rinse water is typically used to keep a pad wet between periods of polishing. Slurry is supplied only during actual polishing in order to minimize consumption. Rinse water is also used on a secondary polishing pad, known as a buff pad, to scrub particles of slurry and adherent chemicals from the wafer before the wafer is removed from the polisher.

U.S. Pat. No. 3,549,439 (Kaveggia et al.) discloses a chemical lapping apparatus in which a pump is used to remove lapping compound from a lapping plate surrounded by a ridge for retaining the lapping reagent atop the plate and pumps the lapping compound through a filter to a separate reservoir. The lapping compound dissociates when heated to chemically react with the workpiece. In the reservoir, chemicals are added to the solution to maintain the desired concentration of lapping compound. Another pump then pumps the adjusted solution back onto the plate. This patent is similar to the Chandler patent in that a ridge or containment device is used to dam the liquid, thereby keeping a set level of slurry or lapping compound on the polishing pad.

U.S. Pat. No. 4,459,781 (Li) discloses applying an abrasive slurry containing a mixture of particle sizes to a rotating polishing wheel and allowing centrifugal force to separate the particles by size. A workpiece is polished by moving from the outer edge of the wheel toward the center of the wheel, where the smallest particles are. This is effective only for slurries containing relatively large particles.

U.S. Pat. No. 5,478,435 (Murphy et al.) discloses a point-of-use slurry dispensing system for CMP apparatus in which concentrated slurry, a diluting agent and, in some instances, a third chemical, are delivered separately to a polishing pad and mixed on the pad or in a dispensing line just prior to use, for control over dilution, temperature, and chemical infusion. Mixing takes place immediately on the pad before the slurry is swept under the wafer or in a small section of plumbing immediately adjacent the rotating pad. The patent relates to on-pad mixing and does not discuss reducing the amount of slurry used, recycling the slurry, rejuvenating used slurry, or recycling rinse water.

The amount of slurry delivered to a polishing pad depends on the material being polished, among other variables, and can vary widely. Slurry can flow onto the polishing pad at 20–500 milliliters per minute, with a typical flow of about 200 ml/min. Many users try to minimize the flow since the slurry is fairly expensive. The flow of slurry onto the polishing pad and the resulting hydrodynamics of the slurry circulating under the wafer are important to high speed and uniform polish. Polishing typically takes two to three minutes per polish cycle and consumes 400 to 600 milliliters of slurry, based upon 200 ml/min flow rate. Consumption of slurry can be as high as 1500 ml per cycle based upon a flow of 500 ml/min.

In typical CMP systems, slurry and rinse water are not segregated, both being directed down a waste drain. The volume of rinse water used is typically more than thirty times the volume of slurry used and can be more than one hundred twenty times the volume of slurry consumed. In a semiconductor manufacturing plant producing 10,000 wafers per month with three separate CMP cycles, from 12,000 to 18,000 liters of slurry per month are consumed and sent to waste drain, mixed with over 180,000 liters, or more, of water. This large chemical consumption adds considerably to the adverse environmental impact of wafer fabrication and adds considerably to the cost of manufacture.

Although CMP slurry is expensive, the risk of damaging a wafer whose value is between $10,000 and $50,000 must be weighed against the cost savings achieved by using recycled slurry. As a practical matter, the risk of damage from recycled slurry cannot be greater than the risk of damage from fresh slurry. The semiconductor industry needs a new, highly reliable solution to reducing the cost of CMP slurry through an effective slurry reprocessing and reuse system. Additionally, the semiconductor industry needs a new, highly reliable solution to reducing the cost of rinse water in CMP.

In view of the foregoing, it is therefore an object of the invention to reduce the consumption of slurry in CMP apparatus.

Another object of the invention is to provide an online process for continuously recycling slurry in CMP apparatus.

A further object of the invention is to provide recycled slurry for CMP apparatus in which the risk of damage from the recycled slurry is no greater than the risk of damage from fresh slurry.

Another object of the invention is to rejuvenate slurry in polishing apparatus.

A further object of the invention is to provide an improved CMP process by recirculating slurry and by adding chemicals to rejuvenate the slurry.

Another object of the invention is to improve the uniformity and consistency of a CMP apparatus.

A further object of the invention is to reduce the cost of operating CMP apparatus.

A further object of the invention is to recycle slurry in CMP apparatus without a substantial change in process, materials, or equipment, other than consuming less materials.

Another object of the invention is to retain the advantages of a continuous flow of slurry across the polishing pad while recycling the slurry.

A further object of the invention is to recycle slurry without causing abrupt changes in the physical or chemical characteristics of the slurry.

Another object of the invention is to reduce the consumption of rinse water in CMP apparatus.

SUMMARY OF THE INVENTION

The foregoing objects are achieved in the invention in which recycled slurry is not merely substituted for fresh slurry but, rather, the recycled slurry is continuously blended with the slurry in use to provide a consistent polishing rate while consuming or discarding a small fraction of the slurry flowing continuously across the polishing pad. The slurry is recovered in a catch ring and fed to a recycle loop to blend the recovered slurry with fresh slurry, rejuvenating chemicals, or water; test the blend; filter the blend; and return the blend to the polishing pad. The volume returned to the pad preferably slightly exceeds the volume recovered, causing the trough to overflow. Rinse water is recycled in the same fashion to keep the polishing pad wet between polishing cycles.

BRIEF DESCRIPTION OF THE DRAWINGS

A more complete understanding of the invention is obtained by considering the following detailed description in conjunction with the accompanying drawings, in which.

DETAILED DESCRIPTION OF THE INVENTION

Figure 1:
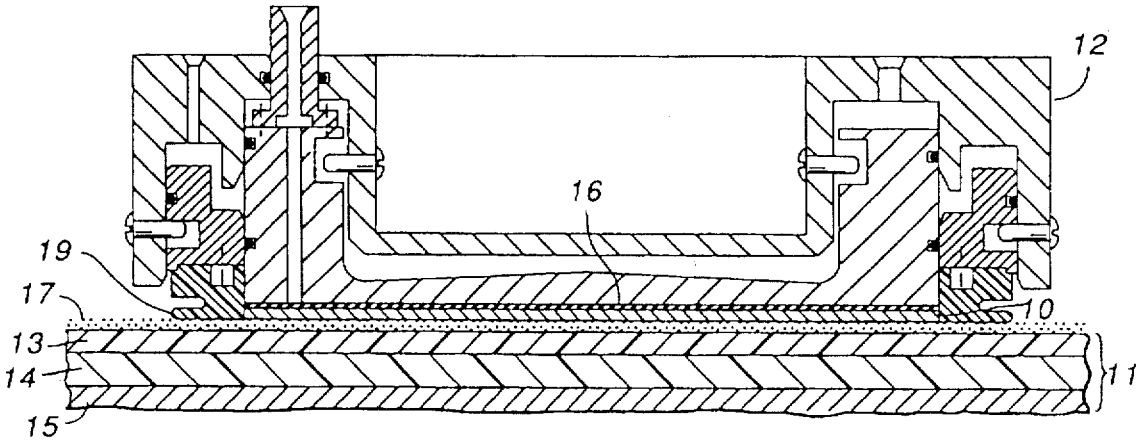
FIG. 1 illustrates a polishing head constructed in accordance with the prior art.

In FIG. 1, semiconductor wafer 10 is placed face-down on polishing pad 11 which includes polyurethane layers 13 and 14 on metal platen 15. Pad 11 is typically 50–75 cm. in diameter in a CMP system having a rotating table and is typically 25–38 cm. in diameter in CMP system having an oscillating table. Carrier 12 applies a downward force against the backside of wafer 10 through carrier pad 16. Carrier 12 includes retaining ring 19 that is slightly larger in diameter than the wafer to be polished.

The retaining ring surrounding a wafer in a polishing head has an inside diameter slightly larger than the diameter of the wafer and there is always a slight gap between the wafer and the ring. Whether the ring presses against the resilient polishing pad or not, there is inevitably an annular region about the periphery of the wafer where the polishing is not uniform, known in the art as "edge exclusion." Edge exclusion is typically 5–10 mm. wide and reduces the area of the wafer from which good die can be obtained.

Carrier 12, and wafer 10, rotate to provide more uniform polishing than obtainable if the wafer did not rotate. Carrier 12 also moves radially on pad 11 to improve uniformity of polish. Slurry 17 puddles slightly on pad 11 during polishing, flowing and circulating under wafer 10 as the wafer moves relative to the pad. The slurry initiates the polishing process by chemically and mechanically reacting with the film being polished. Polishing continues until the desired amount of material has been removed.

Figure 2:
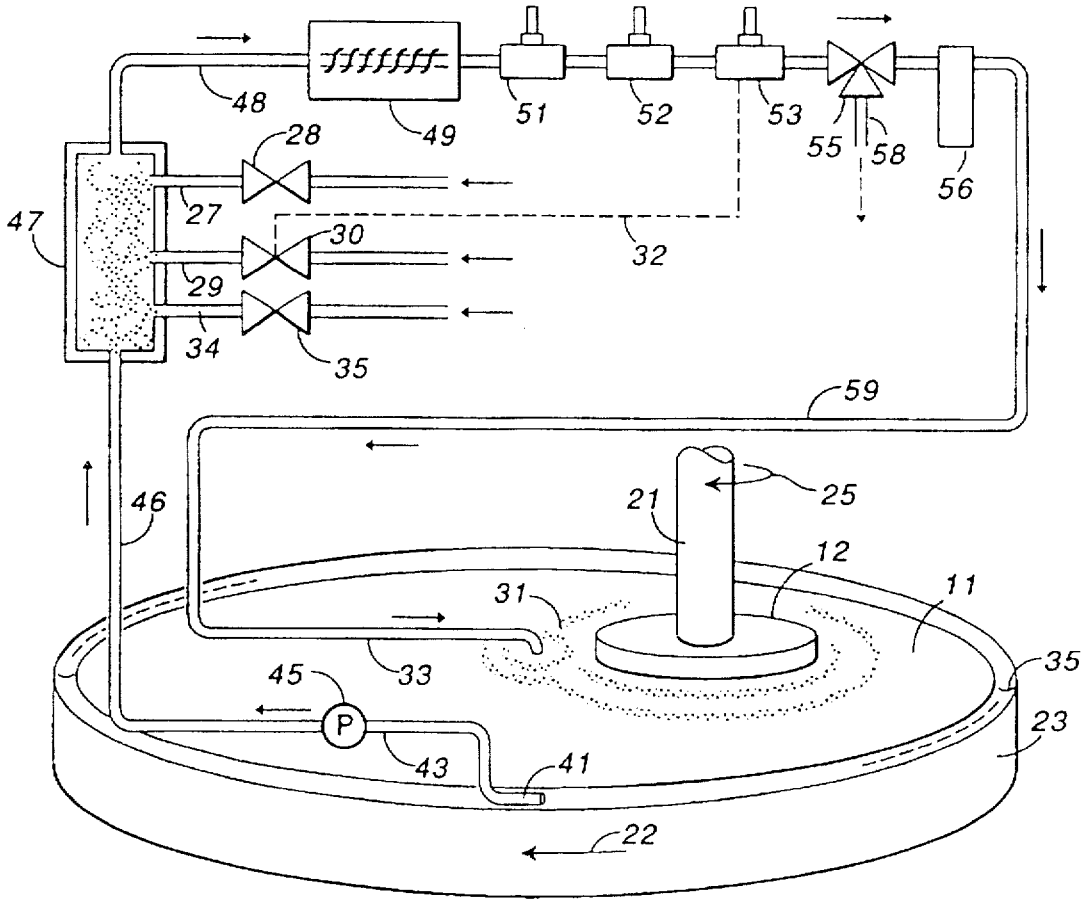
FIG. 2 illustrates re-circulating slurry in CMP apparatus constructed in accordance with the invention.

FIG. 2 illustrates apparatus for re-circulating slurry in accordance with the invention. The polishing process itself is similar to the prior art and the construction of the pad and wafer carrier is the same as in the prior art. That is, recirculating slurry in accordance with the invention does not require changes in the remainder of the CMP apparatus nor a change in the chemistry of the fresh slurry. The invention reduces the consumption of slurry without any penalty or trade-off.

A semiconductor wafer (not shown in FIG. 2) is pressed against pad 11 and rotated by carrier 12, which is attached to shaft 21. Pad 11 rotates clockwise, as indicated by arrow 22, and carrier 12 rotates clockwise, as indicated by arrow 25. Slurry 31 flows onto pad 11 through dispensing tube 33 and flows radially outward over pad 11. A portion of slurry 31 is used to polish a wafer as the slurry flows over the pad. Slurry flowing outward from the perimeter of pad 11 is caught in catch ring 23, which is part of or is attached to the perimeter of the pad.

In the prior art, slurry flows off the edge of a pad and strikes a vertical wall spaced from the pad and then flows down to a collection drain. During this time, the slurry can dry out because the surface area to volume of the slurry can become very high, particularly if droplets are formed. In addition, particles can agglomerate and the slurry is unfavorably changed. Catch ring 23 captures the slurry as it comes off pad 11 without allowing slurry to have a large, exposed surface area or to dry out.

Figure 3:
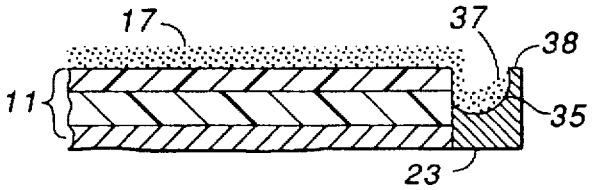
FIG. 3 is a cross-section of a polishing pad and catch ring for apparatus for rejuvenating slurry in accordance with the invention.

FIG. 3 is a cross-section of catch ring 23 and the edge of pad 11. Catch ring 23 extends around the perimeter of pad 11 and includes trough 35 for recovering used slurry 37. Trough 35, illustrated as approximately semi-circular in cross-section, can have any desired cross-sectional shape but it is preferred that outer wall 38 of the trough be approximately the same height as the upper surface of pad 11. Trough 35 is machined with a smooth surface and ring 23 is preferably coated with a layer (not shown) of non-stick plastic such as Teflon® plastic to prevent used slurry 37 from sticking, drying out, or agglomerating, and from abrading the trough.

Figure 4:
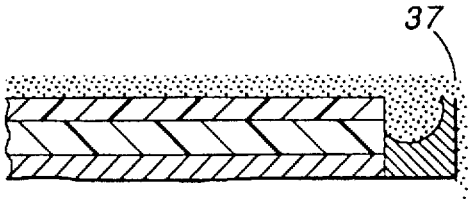
FIG. 4 illustrates the catch ring overflowing.

In a preferred embodiment of the invention, as illustrated in FIG. 4, the used slurry overflows catch ring 23 as it is displaced by the recycled slurry. As described more fully below, about twenty percent of the slurry is replaced with fresh slurry during the course of a polishing cycle, a significant savings over the prior art. The amount of fresh slurry added can be varied over a wide range, e.g. less than one percent to almost one hundred percent.

In FIG. 2, pickup tube 41 lies in trough 35 and withdraws a portion of used slurry from the trough and delivers it through pipe 43 to the input of pump 45. The output of pump 45 is coupled through pipe 46 to mixing manifold 47. In one embodiment of the invention, pickup tube 41 and the piping was made from Teflon® plastic. Any material that is sufficiently rigid, or rigidly supported, to stay in the trough and that does not chemically react with the slurry can be used instead.

Fresh slurry is supplied from a suitable container or reservoir (not shown) through pipe 27 from valve 28 to manifold 47. Rejuvenating chemicals, such as alkali, surfactant, suspension agents, acids, oxidizers, or other chemical agents appropriate for the material being polished, are supplied from a suitable container or reservoir (not shown) through pipe 29 by valve 30 to manifold 47. The nature of the rejuvenating chemicals may require that separate pumps and pipes be used to deliver the rejuvenating chemicals to manifold 47.

De-ionized water is fed under pressure to normally closed valve 35. The output of valve 35 is connected through pipe 34 to manifold 47. Deionized water is used to dilute the slurry or for rinsing wafers or equipment. Rejuvenating chemical, fresh slurry, used slurry and, in some cases, de-ionized water are combined and thoroughly mixed in manifold 47. The resulting recycled slurry flows through pipe 48 to optional heat exchanger 49 where it is heated or cooled to maintain the recycled slurry at a desired temperature.

From heat exchanger 49, recycled slurry flows through a plurality of sensors, such as pH sensor 51, temperature sensor 52, and conductivity sensor 53. Other sensor that might be appropriate for a particular application include a turbidity sensor, densitometer, ion-specific electrodes, voltammeter cells, infrared sensors, ultraviolet sensors, or visual sensors. Sensors are used for information, alarm, and control, singly or in combination, in one or more feedback loops for controlling the characteristics of the recycled slurry. For example, conductivity sensor 53 is part of control loop 32 for automatically metering the flow of akali or acid through valve 30.

Recycled slurry flows through three-way valve 55 to filter 56 and flows through pipe 59 and dispensing tube 33 onto pad 11. The location of the end of tube 33 is not critical but is preferably near the center of polishing pad 11 because of the centrifugal flow of liquid across the surface of the pad.

In some applications, such as rinse cycles, the liquid from manifold 47 is directed to a drain (not shown) through pipe 58.

Large slurry particles are removed in filter 56. In a preferred embodiment of the invention, filter 56 is designed to remove particles larger than 25μ (microns) in diameter. Other filter sizes can be used and filters designed to remove particles larger than 100μ tend to last longer than filters removing smaller particles.

As the volume of recycled slurry builds up on the pad due to the influx of fresh slurry, rejuvenating chemicals, or water, the excess slurry simply flows over top of catch ring 23 and into a drain, not shown. The system functions as a feed and bleed system at steady state, where the volume of liquid added to the system equals the volume flowing to drain. In a preferred embodiment of the invention, the volume flowing through the recycle loop is larger than the volume flowing to drain. A range of about three to ten times the amount sent to drain has been found useful and a range of four to six times the amount sent to drain is preferred.

Allowing slurry to flow off pad 11 and into catch ring 23 without excessively accumulating on pad 11 provides a slurry having essentially constant chemical and physical characteristics. Both the Chandler patent and the Kaveggia et al. patent teach a ring or ridge to hold a quantity of slurry on the polishing surface; i.e. the patents disclose a batch process in which the characteristics of the slurry vary continuously during polishing and vary abruptly from the end of one polishing cycle to the beginning of the next polishing cycle when the slurry is changed. Such variation is at odds with consistency and uniformity.

Allowing the slurry to overflow the catch ring reduces the amount of slurry to be rejuvenated and, to a small extent, provides centrifugal filtering of the slurry; i.e. larger or heavier particles tend to be in the overflow rather than in the trough. This eliminates some particles that would otherwise have to be removed by filter 56.

Another feature of the invention is that the various components making up the recycled slurry are thoroughly mixed and blended before they are dispensed onto the pad. A series of measurements that determine the quality of the slurry, such as temperature, pH, and conductivity, are made before the slurry is dispensed and the slurry should be well mixed for the measurements to be valid. Thus, a point-of-use dispensing system as disclosed in the patent to Murphy et al. is not desirable. Thorough mixing assures more accurate measurements and better process control.

Although it is preferred to measure temperature, pH, and conductivity, any desired parameter can be monitored or no parameter need be monitored. Without measurements of the recycled slurry, the process would work well because of the thorough mixing of the slurry but other parts of the process become more critical, such as the fluid flow being well characterized and consistent and the wafer process being well characterized and consistent.

Figure 5:
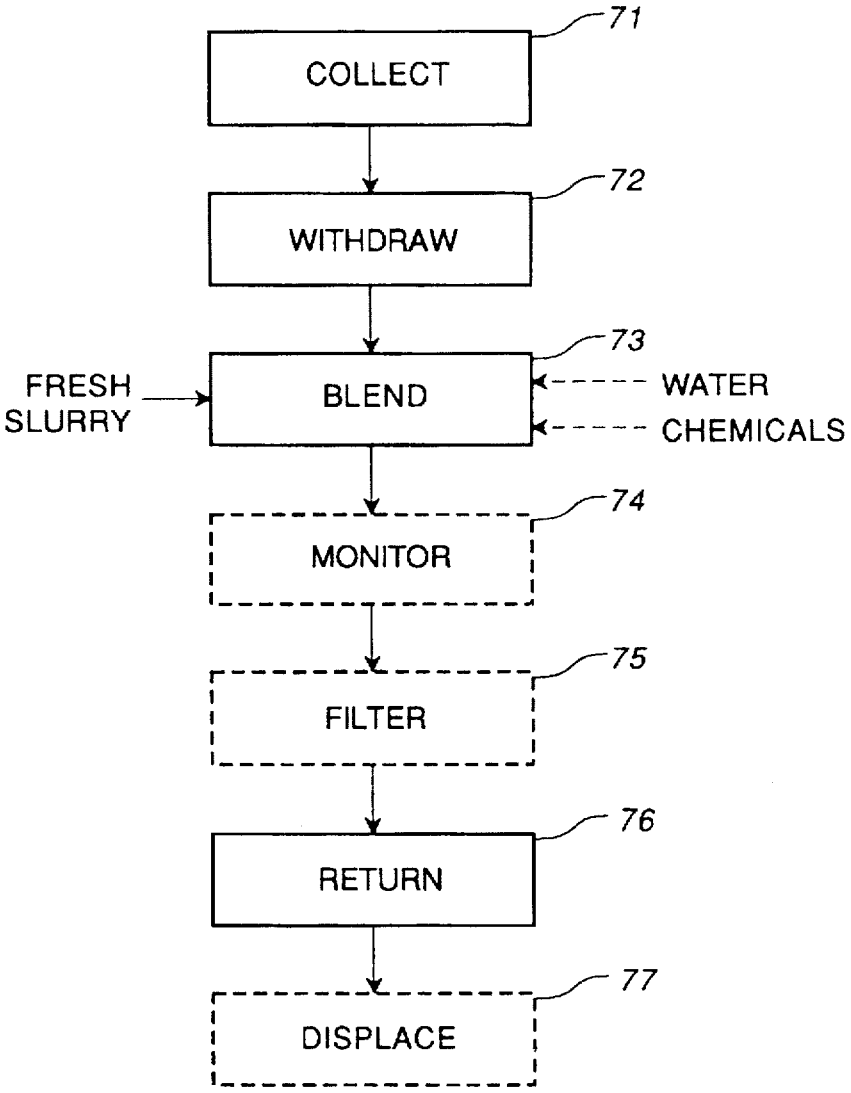
FIG. 5 is a flow chart of a recycling process in accordance with the invention.

FIG. 5 is a flow chart of slurry treatment in accordance with the invention. The flow chart assumes that the system has been operating. Starting from a new, dry polishing pad involves moistening the pad, applying fresh slurry, and bringing the system up to speed as the slurry enters the recirculating loop for the first time. At the other extreme, a shut-down entails flushing the system with de-ionized water, turning off the recirculation loop, letting all the water overflow the trough, and pumping the remaining water to drain through valve 55.

After the slurry is circulating through the system, a wafer is loaded into a carrier and applied to the polishing pad. A portion of the slurry is collected, step 71, from the catch ring and a portion of the slurry overflows the catch ring to a drain. The recovered slurry is pumped, step 72, to the mixing manifold, along with rejuvenating chemicals, as needed, fresh slurry, and water, as needed. The mixing manifold blends the components, step 73, and passes the recycled slurry to the mensuration phase of the process, step 74. Temperature and other parameters are measured and the valves and heat exchanger are adjusted in accordance with the data from the sensors. The recycled slurry is then filtered, step 75. After filtration, the recycled slurry is sent back to the polishing pad and the recycling continues until polishing is completed. Preferably, the amount of recycled slurry returned exceeds the amount removed, thereby displacing a fraction of the slurry from the system, step 77.

A large amount of deionized water is used periodically, and sometimes overnight, to keep a polishing pad wet and to prevent slurry from drying on the pad. In accordance with another aspect of the invention, one can save substantial amounts of de-ionized water by recirculating de-ionized water or pH adjusted water for long standby times to keep the pad wet. Additionally, the periodic wetting of the pad by de-ionized water is totally eliminated since the recycle slurry is kept flowing even during standby times.

One can recycle chemicals other than slurry for CMP. In many processes, a second polishing or buffing step is performed on a second polishing table using deionized or pH adjusted rinse water and a selected pad. One can recycle the rinse chemicals for the second polishing table in the same manner as the slurry, i.e. withdraw (with or without overflow), rejuvenate, measure, filter, and recirculate.

A more complete understanding of the invention can be obtained by considering the following examples, which are presented for illustration rather than limitation.

Two tests were conducted using a IPEC model 472 CMP system, Cabot SS12 slurry, Rodel IC1000 and Rodel SubaIV primary pads, Rodel DF200 carrier film, and 200 mm wafers coated with thermal oxide. The wafers were polished following standard procedures for two minutes. An IPEC model Avanti 9000 was used for post-CMP cleaning. A Tencor model FT1050 was used for both pre-polishing measurements and post-polishing measurements of oxide thickness and a Tencor model 6200 was used for both pre-polishing measurements and post-polishing measurements of scratches and defects on the surface of the control wafers. Within wafer non-uniformity (WIWNU) was measured using a standard forty-nine point SEMI thickness measurement, measured at both 6 mm edge exclusion and 10 mm edge exclusion.

EXAMPLE #1

Two hundred wafers were planarized using recycled slurry with a feed of 40 milliliter per minute (ml/min) of fresh slurry and a recycled slurry feed of 160 ml/min. The recycle rate represents a reduction by a factor of five from normal slurry usage, from 200 ml/min fresh slurry to 40 ml/min fresh slurry.

The test was conducted using the oxide wafer polish process available from IPEC for the model 472 CMP system. Every tenth wafer was a pre-measured 200 mm prime virgin thermal oxide wafer while the rest were fillers with oxide. A total of one hundred forty wafers were processed on the first day. During the first day, the process appeared to be relatively stable. The process was continued the next day. Although the removal rate was stable, the individual wafer non-uniformity started increasing due to what appeared to be degradation of the carrier film. The test was terminated after two hundred wafers.

The degradation was not related to the use of recycled slurry since ten additional wafers with two monitors were processed using 100% fresh slurry and they showed the same degradation. The results of test #1 are given in the following Table 1, with removal rate (R.R.) measured in Angstroms per minute (AÅ/min) and non-uniformity measured in percent for a one sigma standard deviation.

TABLE 1

| | | | |
|---|---|---|---|
| Day 1R | 140 wafers | 14 monitors | recycle slurry |
| Day 2R | 60 wafers | 6 monitors | recycle slurry |
| Day 2F | 10 wafers | 2 monitors | 100% fresh slurry |

| | 6 mm edge-exclusion | | 10 mm edge-exclusion | |
|---|---|---|---|---|
| | R.R., Å/min | % WIWNU | R.R., Å/min | % WIWNU |
| DAY 1 R | 1632 | 5.76 | 1720 | 4.96 |
| DAY 2 R | 1641 | 10.91 | 1619 | 9.07 |
| DAY 2 F | 1769 | 18.72* | 1676 | 11.5 * |

* continuing deterioration
200 wafer run, Scratch results

| | | |
|---|---|---|
| Average scratch count: | pre = 21.35 | /post = 20.7 |
| Average scratch length: | pre = 46.5 mm | /post = 43.3 mm |
| pH range (no pH adjustment) | Fresh = 11.25 average pH; | Recycle = 11.05 average pH |

EXAMPLE #2

A second test was started using new pads and a new carrier film. Alternate cassettes (twenty wafers; two prime virgin TOX monitors every tenth wafer) were processed using recycled and new SS12 slurry. Periodic samples of slurry were taken for analysis. One hundred wafers were processed on day three and another hundred on day four. This time the removal rate and WIWNU remained stable. Table 2 gives the results for test 2. Wafer to wafer nonuniformity in removal rate (WTWNU) was also measured.

TABLE 2

| | Recycled Slurry | Fresh Slurry |
|---|---|---|
| R.R. Avg.; 10 mm e.e. | 1715.6 Å/min. | 1775.6 Å/min. |
| WIWNU | 3.71% | 4.43% |
| WTWNU | 1.62% | 1.93% |
| R.R. Avg.; 6 mm e.e. | 1680.2 Å/min. | 1735.4 Å/min. |
| WIWNU | 4.20% | 4.35% |
| WTWNU | 2.23% | 2.74% |
| Change in Total Scratch Count, Avg. per wafer | −0.75 | −1.67 |
| Change in Total Scratch Size, Avg. per wafer | −1.17 mm | −3.33 mm |

Test results from all four days of testing on four hundred wafers show that, with the aid of the invention, a significant savings in fresh slurry usage, from 200 ml/min down to 40 ml/min, was achieved at substantially the same performance as 100% fresh slurry.

Having thus described the invention, it will be apparent to those of skill in the art that various modifications can be made within the scope of the invention. For example, peristaltic pumps were used in one embodiment of the invention but other types of pump can be used instead. While thin films on wafers have been discussed, the recycling system will work equally well for polishing and planarizing bare silicon wafers. The invention can be applied to other technologies, such as planarizing materials for flat panel displays. Still other applications for the invention include glass, plastic, electroless nickel on hard disk drive surfaces, printed circuit multilayer ceramic packages, chip carriers, and the like. The invention can be used to recycle all types of slurry and can be used to recycle chemicals other than slurry in the CMP process. The apparatus could work satisfactorily without a filter or without a rejuvenating chemical added. In the simplest form of the invention, mixing used slurry from the catch ring with fresh slurry and returning the mixture to the pad, has been shown to work to a satisfactory level for CMP polishing. The volume of material filtered can be reduced by filtering recovered slurry instead of filtering recycled slurry. The collection tube and the dispensing tube can have several holes along their length, including or instead of an open end for collecting or dispensing slurry. A catch ring is used for a rotating pad. A similar device is used for an oscillating pad or for a belt, except that the device need not move with the pad or belt. A retaining ring having an abrasive lower surface can be used as a conditioner.

What is claimed as the invention is:

1. A method for recycling rinse water in a CMP apparatus, the rinse water comprising substantially less than 1% abrasive solids by weight, in which the rinse water is applied to a polishing pad, said method comprising the steps of:

at least partially surrounding the pad with a catch ring to collect the rinse water that flows off the pad;

withdrawing rinse water from the ring; and returning the rinse water to the pad.

2. The method as set forth in claim 1 wherein said withdrawing step withdraws less than all the rinse water that flows off the pad.

3. The method as set forth in claim 1 and further including the step of:

conditioning the pad while the rinse water flows over the pad; and filtering the rinse water prior to said returning step.

* * * * *